US012134800B2

(12) United States Patent
Kim

(10) Patent No.: US 12,134,800 B2
(45) Date of Patent: Nov. 5, 2024

(54) HIGHLY THICK STEEL MATERIAL HAVING EXCELLENT LOW-TEMPERATURE IMPACT TOUGHNESS AND MANUFACTURING METHOD THEREFOR

(71) Applicant: POSCO CO., LTD, Pohang-si (KR)

(72) Inventor: Dae-Woo Kim, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 0 days.

(21) Appl. No.: 18/265,570

(22) PCT Filed: Nov. 18, 2021

(86) PCT No.: PCT/KR2021/017015

§ 371 (c)(1),
(2) Date: Jun. 6, 2023

(87) PCT Pub. No.: WO2022/139191

PCT Pub. Date: Jun. 30, 2022

(65) Prior Publication Data

US 2024/0035107 A1 Feb. 1, 2024

(30) Foreign Application Priority Data

Dec. 21, 2020 (KR) ..... 10-2020-0180190

(51) Int. Cl.

| | |
|---|---|
| ***C21D 1/18*** | (2006.01) |
| ***C21D 1/84*** | (2006.01) |
| ***C21D 6/00*** | (2006.01) |
| ***C21D 8/00*** | (2006.01) |
| ***C21D 9/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |

(52) U.S. Cl.

CPC ..... *C21D 9/0081* (2013.01); *C21D 1/18* (2013.01); *C21D 1/84* (2013.01); *C21D 6/004* (2013.01); *C21D 6/005* (2013.01); *C21D 6/008* (2013.01); *C21D 8/005* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C21D 2211/002* (2013.01); *C21D 2211/005* (2013.01); *C21D 2211/008* (2013.01)

(58) Field of Classification Search

None

See application file for complete search history.

(56) References Cited

U.S. PATENT DOCUMENTS

| | | | | |
|---|---|---|---|---|
| 10,000,833 | B2 * | 6/2018 | Kitsuya | C21D 8/0205 |
| 10,351,926 | B2 * | 7/2019 | Kuronuma | C22C 38/04 |
| 10,604,817 | B2 * | 3/2020 | Kim | C22C 38/42 |
| 2016/0010192 | A1 | 1/2016 | Kitsuya et al. | |
| 2019/0024206 | A1 | 1/2019 | Kim | |
| 2019/0100818 | A1 | 4/2019 | Kim et al. | |
| 2021/0062285 | A1 | 3/2021 | Kim | |
| 2021/0301365 | A1 | 9/2021 | So et al. | |

FOREIGN PATENT DOCUMENTS

| | | | |
|---|---|---|---|
| CA | 3 108 674 | A1 | 2/2020 |
| EP | 3 222 744 | B1 | 9/2020 |
| EP | 3 929 323 | A1 | 12/2021 |
| JP | 9256037 | A | 9/1997 |
| JP | 1171615 | A | 3/1999 |
| JP | 2012-102393 | A | 5/2012 |
| JP | 2018-504519 | A | 2/2018 |
| JP | 2019-504210 | A | 2/2019 |
| KR | 10-2012-0075246 | A | 7/2012 |
| KR | 10-2013-0076570 | A | 7/2013 |
| KR | 10-1736638 | A | 5/2017 |
| KR | 10-2019-0077830 | A | 7/2019 |
| KR | 10-2031499 | A | 10/2019 |
| KR | 10-2020-0066512 | A | 6/2020 |
| KR | 10-2020-0076829 | A | 6/2020 |
| WO | 2020130354 | A1 | 6/2020 |

OTHER PUBLICATIONS

International Search Report for PCT/KR2021/017015 dated Apr. 27, 2022.

Extended European Search Report issued May 7, 2024 in European Application No. 21911258.8.

Office Action issued Jul. 2, 2024 in Japanese Application No. 2023-537650.

Lucía Rancel, et al., "Measurement of bainite packet size and its influence on cleavage fracture in a medium carbon bainitic steel", Materials Science and Engineering A, 2011, vol. 530, pp. 21-27 (7 pages total).

* cited by examiner

*Primary Examiner* — Daniel J. Schleis

(74) *Attorney, Agent, or Firm* — Sughrue Mion, PLLC

(57) ABSTRACT

The present invention relates to a highly thick steel material and a manufacturing method therefor and, more specifically, to a highly thick steel material that exhibits excellent low-temperature impact toughness after long-term PWHT although the steel sheet is thick, and a manufacturing method therefor.

10 Claims, No Drawings

HIGHLY THICK STEEL MATERIAL HAVING EXCELLENT LOW-TEMPERATURE IMPACT TOUGHNESS AND MANUFACTURING METHOD THEREFOR

This Application is a National Stage of International Application No. PCT/KR2021/017015 filed Nov. 18, 2021, claiming priority based on Korean Patent Application No. 10-2020-0180190 filed Dec. 21, 2020, the entire disclosures of which are incorporated herein by reference.

TECHNICAL FIELD

The present disclosure relates to a highly thick steel material and a manufacturing method thereof, and to a highly thick steel material having excellent low-temperature impact toughness and a manufacturing method thereof.

BACKGROUND ART

In recent years, due to crude oil refining and the large-scale and high-capacity storage of storage facilities, demand for thickening of steel materials used therefor has been continuously increasing, and in particular, with the increase in use in cold environments, the temperature at which low-temperature impact toughness is guaranteed has been gradually decreasing.

In manufacturing large structures, there is a tendency to control defects of steel materials such as non-metallic inclusions, segregation, internal voids, and the like to the limit in order to improve the internal and external soundness of steel materials. In addition, it is required to lower the carbon equivalent (Ceq) in order to secure the structural stability of the heat-affected zone after welding as well as the base material.

In particular, in the case of ultra-thick materials with a thickness exceeding 100 mm, compared to thin materials, since the rolling reduction ratio is not high, the unsolidified shrinkage holes generated during continuous casting or casting are not sufficiently compressed during the rough rolling process and remain in the form of residual voids in the central portion of the product. These residual voids act as a starting point for cracks in the structure at the time of impact, and eventually cause damage to the entire equipment due to a decrease in low-temperature impact toughness. Therefore, a process of sufficiently compressing the central voids is required so that no residual void remains at the stage before rolling.

Patent Document 1, related thereto, corresponds to a technology of a lower pressure in a thick plate rough rolling process, and uses a technique for determining the limiting reduction rate for each thickness at which plate bite occurs by thickness from the reduction rate for each pass set to be close to the design tolerance (load and torque) of the rolling mill, a technique of distributing the reduction ratio by adjusting the index of the thickness ratio for each pass to secure the target thickness of the roughing mill, and technology to modify the rolling reduction ratio so that plate bite does not occur based on the limit rolling reduction ratio for each thickness, and thus, provided is a manufacturing method capable of applying an average reduction rate of about 27.5% in the final 3 passes of rough rolling based on 80 mm. However, in the case of the rolling method, the average reduction rate of the entire product thickness was measured, and it is difficult to apply high strain to the central portion of the ultra-thick material with a maximum thickness of 250 mm where residual voids are present.

On the other hand, as the thickness of the steel material increases, the post-weld heat treatment (PWHT) temperature or time increases. PWHT is a method to prevent structural deformation and secure shape and dimensional stability by removing residual stress at the welded zone. Normally, PWHT is performed on the entire structure, but even if it is performed locally, the base material other than the welded zone is also exposed to a heat source, which may cause deterioration of physical properties of the base material. For this reason, in the case of ultra-thick materials, the quality of the base material may be deteriorated after high-temperature and long-term PWHT heat treatment, which may cause a decrease in the equipment lifespan of the manufactured pressure vessel. During such PWHT, in the case of high-strength pressure vessel steels composed of hard phases such as bainite, martensite, martensite-austenite constituent (MA), and the like, the base material is subjected to a series of processes such as carbon re-diffusion, dislocation recovery, crystal grain growth (bainite or martensite interface movement) and carbide growth, precipitation, and the like, thereby not only losing strength but also trending to increase the ductile-brittle transition temperature (DBTT).

As a means to prevent deterioration of physical properties due to high temperature and long-term PWHT, first, there is a method of reducing the amount of strength deterioration by increasing the amount of alloy elements that may increase hardenability even if Ceq is high to increase the fraction of the tempered low-temperature phase even after heat treatment. The second is a method of increasing the content of elements having a solid solution strengthening effect, such as Mo, Cu, Si, and C in order to increase the matrix strength of ferrite without a change in structure and dislocation density after heat treatment, while implementing the microstructure of Quenching-Tempering (QT) steel as a two-phase structure composed of ferrite and bainite or a three-phase structure including a certain amount of martensite in addition to the above structure.

However, both of the above methods have disadvantages in that the toughness of the heat affected zone (HAZ) is likely to decrease due to the increase in Ceq, and manufacturing costs increase due to the addition of solid-solution strengthening elements.

As another method, it is a precipitation strengthening method using rare earth elements, and it is an effective method under a specific composition range and application temperature conditions. Patent Document 2 related thereto, discloses the processes of heating and hot rolling a slab including, in weight %, C: 0.05 to 0.20%, Si: 0.02 to 0.5%, Mn: 0.2 to 2.0%, Al: 0.005 to 0.10%, a balance of Fe, and unavoidable impurities, and additionally containing one or two or more of Cu, Ni, Cr, Mo, V, Nb, Ti, B, Ca, and rare earth elements as needed, and then, air-cooling the slab to room temperature, and slowly cooling after heating at the Ac1-Ac3 transformation point, such that the PWHT guarantee time may be made available up to 16 hours.

However, the PWHT guarantee time obtained by the above technology is very insufficient when the steel material is thickened and the welding conditions are severe, and there is a problem in that it is impossible to apply PWHT for a longer period of time.

PRIOR ART LITERATURE (Patent Document 1) Korean Patent Application Publication No. 10-2012-0075246 (published on Jul. 6, 2012)

(Patent Document 2) Japanese Patent Laid-open Publication No. 1997-256037 (published on Sep. 30, 1997)

SUMMARY OF INVENTION

Technical Problem

An aspect of the present disclosure is to provide a highly thick steel material having excellent low-temperature impact toughness after long-term PWHT even when the steel plate is thick and a manufacturing method thereof.

An aspect of the present disclosure is not limited to the above. A person skilled in the art will have no difficulty understanding the further subject matter of the present disclosure from the general content of this specification.

Solution to Problem

According to an aspect of the present disclosure, a steel material includes, in weight %, carbon (C): 0.10 to silicon (Si): 0.05 to 0.50%, manganese (Mn): 1.0 to 2.0%, aluminum (Al): 0.005 to 0.1%, phosphorus (P): 0.010% or less, sulfur (S): 0.0015% or less, niobium (Nb): 0.001 to vanadium (V): 0.001 to 0.03%, titanium (Ti): 0.001 to chromium (Cr): 0.01 to 0.20%, molybdenum (Mo): 0.01 to 0.15%, copper (Cu): 0.01 to 0.50%, nickel (Ni): 0.05 to calcium (Ca): 0.0005 to 0.0040%, with a balance Fe and unavoidable impurities, wherein a microstructure in a center in a range of t/4 to t/2 (where t indicates ae thickness of a steel plate) consists of 35 to 40% of ferrite and a remainder of bainite composite structure in area %, a packet size of the bainite is 10 μm or less, and a porosity of the center is 0.1 $mm^3/g$ or less, a depth of a surface crack is 0.5 mm or less, and a center section hardness is 200 HB or less.

A prior austenite average grain size of the steel material may be 20 μm or less.

A thickness of the steel material may be 133 to 250 mm.

The steel material may have a tensile strength of 450 to 650 MPa after PWHT and a center low-temperature impact toughness of 80 J or more at −60° C.

According to another aspect of the present disclosure, a method of manufacturing a steel includes primarily heating a steel slab having a thickness of 650 to 750 mm at a temperature ranging from 1100 to 1300° C., and then performing primary forging at a cumulative reduction of 3 to 15% and a strain rate of 1 to 4/s, and obtaining a primary intermediate material, the steel slab containing, in weight %, carbon (C): 0.10 to 0.25%, silicon (Si): 0.05 to 0.50%, manganese (Mn): 1.0 to 2.0%, aluminum (Al): 0.005 to 0.1%, phosphorus (P): 0.010% or less, sulfur (S): 0.0015% or less, niobium (Nb): 0.001 to 0.03%, vanadium (V): 0.001 to 0.03%, titanium (Ti): to 0.03%, chromium (Cr): 0.01 to 0.20%, molybdenum (Mo): 0.01 to 0.15%, copper (Cu): 0.01 to 0.50%, nickel (Ni): 0.05 to 0.50%, calcium (Ca): 0.0005 to 0.0040%, with a balance Fe and unavoidable impurities;

after secondary heating of the primary intermediate material at a temperature ranging from 1000 to 1500° C., performing secondary forging processing at a cumulative reduction of 3 to 30% and a strain rate of 1 to 4/s, and obtaining a secondary intermediate material;

a tertiary heating operation of heating the secondary intermediate material to a temperature range of 1000 to 1200° C.;

obtaining a hot-rolled material by hot-rolling the tertiary heated secondary intermediate material at a finish hot rolling temperature of 900 to 1100° C.;

cooling the hot-rolled material;

a quenching operation of heating the cooled hot-rolled material at a temperature ranging from 820 to 900° C., maintaining for 10 to 40 minutes, and then cooling at a cooling rate of 5° C./s or more; and a tempering operation of holding the quenched steel at 600 to 680° C. for 10 to 40 minutes.

In the cooling, the hot-rolled material may be cooled at a cooling rate of 3° C./s or more to a temperature range of Bs+20 to Ar1+20° C.

An operation of cooling the hot-rolled material to a cooling end temperature and then air-cooling to room temperature may be further included.

A thickness of the primary intermediate material may be 450 to 550 mm.

A thickness of the secondary intermediate material may be 300 to 340 mm.

A thickness of the hot-rolled material may be 133 to 250 mm.

Advantageous Effects of Invention

According to an aspect of the present disclosure, even when the thickness of the steel plate is large, a highly thick steel material having excellent low-temperature impact toughness after long-term PWHT and a manufacturing method thereof may be provided.

According to another aspect of the present disclosure, a steel material that may be used for petrochemical manufacturing facilities, storage tanks, and the like, and a manufacturing method thereof may be provided.

BEST MODE FOR INVENTION

Hereinafter, preferred embodiments of the present disclosure will be described. Embodiments of the present disclosure may be modified in various forms, and the scope of the present disclosure should not be construed as being limited to the embodiments described below. These implementations are provided to describe the present disclosure in more detail to those skilled in the art to which the present disclosure belongs.

Hereinafter, the present disclosure will be described in detail.

Hereinafter, the steel composition of the present disclosure will be described in detail.

Unless otherwise specified in the present disclosure, % and ppm indicating the content of each element are based on weight.

Steel material according to one aspect of the present disclosure may include, by weight %, carbon (C): 0.10 to silicon (Si): 0.05 to 0.50%, manganese (Mn): 1.0 to 2.0%, aluminum (Al): 0.005 to 0.1%, phosphorus (P): 0.010% or less, Sulfur (S): 0.0015% or less, Niobium (Nb): 0.001 to Vanadium (V): 0.001 to 0.03%, Titanium (Ti): 0.001 to 0.03%, Chromium (Cr): 0.01 to 0.20%, Molybdenum (Mo): 0.01 to 0.15%, Copper (Cu): 0.01 to 0.50%, Nickel (Ni): 0.05 to Calcium (Ca): 0.0005 to 0.0040%, balance Fe and unavoidable impurities.

Carbon (C): 0.10 to 0.25%

Since carbon (C) is the most important element in securing the strength of steel material, it needs to be contained in steel within an appropriate range, and 0.10% or more must be added to obtain such an additive effect. On the other hand, if the content exceeds a certain level, the martensite fraction may increase during quenching, which may excessively increase the strength and hardness of the base material, resulting in surface cracks during forging and a decrease in low-temperature impact toughness characteristics in the final product, and thus the upper limit is limited to 0.25%.

Therefore, the content of carbon (C) may be 0.10 to 0.25%, and a more preferable upper limit may be 0.20%.

Silicon (Si): 0.05 to 0.50%

Silicon (Si) is a substitutional element that enhances the strength of steel through solid solution strengthening and is an essential element for manufacturing clean steel due to a strong deoxidation effect thereof. In order to obtain the above-mentioned effect, it should be added in an amount of 0.05% or more, more preferably 0.20% or more. On the other hand, if the content exceeds 0.5%, an MA phase may be formed and the strength of the ferrite matrix may be excessively increased, resulting in deterioration of the surface quality of the ultra-thick product.

Accordingly, the content of silicon (Si) may be 0.05 to 0.50%. More preferably, the upper limit may be 0.40%, and the more preferable lower limit may be 0.20%.

Manganese (Mn): 1.0 to 2.0%

Manganese (Mn) is a useful element that improves strength by solid solution strengthening and improves hardenability so that a low-temperature transformation phase is generated. Therefore, in order to secure a tensile strength of 450 MPa or more, it is preferable to add 1.0% or more of manganese (Mn). A more preferred lower limit may be 1.1%. On the other hand, if the content of manganese (Mn) is excessive, MnS, a non-metallic inclusion elongated with S, may be formed to decrease toughness, which acts as a factor that lowers the elongation rate at the time of tensile in the thickness direction, thereby being a factor of rapidly reducing the low-temperature impact toughness of the center. Therefore, the upper limit is limited to 2.0%, and may be more preferably 1.5%.

Therefore, the content of manganese (Mn) may be 1.0 to 2.0%. More preferably, the upper limit may be 1.5%, and the more preferable lower limit may be 1.1%.

Aluminum (Al): 0.005 to 0.1%

Aluminum (Al) is one of the strong deoxidizers in the steelmaking process in addition to Si. In order to obtain the above effect, it is preferable to add 0.005% or more, and a more preferable lower limit may be 0.01%. On the other hand, if the content of aluminum (Al) is excessive, the fraction of Al2O3 in the oxidative inclusions generated as a result of deoxidation increases excessively, resulting in a coarse size, and there is a problem in that it is difficult to remove the inclusions during refining, and thus the upper limit is 0.1%, and a more preferable upper limit may be 0.07%.

Therefore, the content of aluminum (Al) may be 0.005 to 0.1%. More preferably, the upper limit may be 0.07%, and the more preferable lower limit may be 0.01%.

Phosphorus (P): 0.010% or Less

Phosphorus (P) is an element that causes brittleness by forming coarse inclusions at grain boundaries, and the upper limit is limited to 0.010% or less to improve brittle crack propagation resistance.

Therefore, the content of phosphorus (P) may be 0.010% or less.

Sulfur (S): 0.0015% or Less

Sulfur (S) is an element that causes brittleness by forming coarse inclusions at grain boundaries, and the upper limit is limited to 0.0015% or less to improve brittle crack propagation resistance.

Therefore, the content of sulfur (S) may be 0.0015% or less.

Niobium (Nb): 0.001 to 0.03%

Niobium (Nb) is an element that precipitates in the form of NbC or NbCN to improve the strength of the base material. When reheated to a high temperature, dissolved Nb precipitates very finely in the form of NbC during rolling to have the effect of suppressing the recrystallization of austenite and refining the structure. In order to obtain the above effects, it is preferable to add 0.001% or more of niobium (Nb), and a more preferable lower limit may be 0.005%. On the other hand, if the content is excessively added, undissolved niobium (Nb) is produced in the form of TiNb (C, N) and becomes a factor that impairs the impact toughness properties, and thus the upper limit may be limited to 0.03%, and more preferably, may be 0.02%.

Accordingly, the content of niobium (Nb) may be 0.001 to 0.03%. More preferably, the upper limit may be 0.02%, and the more preferable lower limit may be 0.005%.

Vanadium (V): 0.001 to 0.03%

Since almost all of vanadium (V) is re-dissolved during reheating, the strengthening effect due to precipitation or solid solution during subsequent rolling is insignificant, but it has the effect of improving strength by precipitating as very fine carbonitride in the subsequent heat treatment process such as PWHT or the like. In order to sufficiently secure the above-mentioned effect, it is necessary to add 0.001% or more of the content. More preferably, it may contain 0.01% or more. On the other hand, if the content is excessive, the strength and hardness of the base material and the welded part are excessively increased, which may act as a factor in the occurrence of surface cracks during processing of pressure vessels, and manufacturing costs rapidly rise, which is commercially disadvantageous, and thus the upper limit may be set to 0.03%, and more preferably may be 0.02%.

Therefore, the content of vanadium (V) may be 0.001 to 0.03%, more preferably the upper limit may be 0.02%, and the more preferable lower limit may be 0.01%.

Titanium (Ti): 0.001 to 0.03%

Titanium (Ti) is an element that greatly improves low-temperature toughness by precipitating as TiN during reheating and suppressing the growth of crystal grains in the base material and heat-affected zone, and is preferably added in an amount of 0.001% or more to obtain the above effect. On the other hand, if titanium (Ti) is excessive, the low-temperature impact toughness may be reduced due to clogging of the continuous casting nozzle or crystallization in the center, and when combined with N, coarse TiN precipitates are formed in the center of the thickness, reducing the elongation of the product, so that the lamella tearing resistance of the final material may be deteriorated, and thus the upper limit may be limited to 0.03%, more preferably to 0.025%, and more preferably to 0.018%.

Therefore, the content of titanium (Ti) may be 0.001 to 0.03%, and more preferably the upper limit may be 0.025% and further preferably to 0.018%.

Chromium (Cr): 0.01 to 0.20%

Chromium (Cr) increases yield and tensile strength by increasing hardenability to form a low-temperature transformation structure, and has an effect of preventing strength deterioration by slowing down the decomposition rate of cementite during tempering after rapid cooling or heat treatment after welding. In order to obtain the above-mentioned effect, the lower limit of the content thereof may be limited to 0.01%. On the other hand, if the chromium (Cr) content is excessive, the size and fraction of Cr-Rich coarse carbides such as M23C6 or the like increase and the impact toughness of the product decreases, and the solid solubility of Nb in the product and the fraction of fine precipitates such as NbC decrease, and thus the strength of the product may decrease. Therefore the upper limit thereof may be 0.20%, more preferably 0.15%.

Therefore, the content of chromium (Cr) may be 0.01 to 0.20%, and more preferably the upper limit may be 0.15%.

Molybdenum (Mo): 0.01 to 0.15%

Molybdenum (Mo) is an element that increases grain boundary strength and has a high solid-solution strengthening effect in ferrite, and is an element that effectively contributes to increasing strength and ductility of products. In addition, molybdenum (Mo) has an effect of preventing deterioration in toughness due to grain boundary segregation of impurities such as P or the like. It is preferable to add 0.01% or more to obtain the above-mentioned effect. On the other hand, since molybdenum (Mo) is an expensive element and excessive addition may significantly increase manufacturing costs, the upper limit may be limited to 0.15%.

Accordingly, the content of molybdenum (Mo) may be to 0.15%. A more preferred lower limit may be 0.05%, and a more preferred upper limit may be 0.12%.

Copper (Cu): 0.01 to 0.50%

Copper (Cu) is an advantageous element in the present disclosure because it has an effect of not only greatly improving the strength of the matrix phase by solid solution strengthening in ferrite and but also inhibiting corrosion in a wet hydrogen sulfide atmosphere. In order to obtain such an effect, 0.01% or more may be added, and more preferably 0.03% or more may be added. On the other hand, if the content of copper (Cu) is excessive, there is a possibility of causing star cracks on the surface of the steel plate, and as it is an expensive element, there is a problem in that manufacturing cost increases significantly, and thus the upper limit thereof may be limited to 0.50%, preferably, to 0.30%.

Therefore, the content of copper (Cu) may be 0.01 to More preferably, the upper limit may be 0.30%, and the more preferable lower limit may be 0.03%.

Nickel (Ni): 0.05 to 0.50%

Nickel (Ni) is an important element for improving impact toughness by facilitating cross slip of dislocations by increasing stacking faults at low temperatures, and improving strength by improving hardenability. It is preferable to add 0.05% or more to obtain the above-mentioned effect, and may be more preferably 0.10% or more. On the other hand, if the content is excessive, manufacturing costs may increase due to high cost, and thus the upper limit thereof may be limited to 0.50%, and more preferably 0.30%.

Accordingly, the content of nickel (Ni) may be 0.05 to 0.50%. More preferably, the upper limit may be 0.30%, and the more preferable lower limit may be 0.10%.

Calcium (Ca): 0.0005 to 0.0040%

When calcium (Ca) is added after deoxidation by Al, it has the effect of suppressing the generation of MnS by combining with S and simultaneously suppressing the occurrence of cracks due to hydrogen-induced cracking by forming spherical CaS. In order to sufficiently form S contained as an impurity into CaS, it is preferable to add 0.0005% or more. On the other hand, if the content thereof is excessive, CaS is formed and remaining Ca combines with O to form coarse oxidative inclusions. As a result, since there is a problem in that low-temperature impact toughness is deteriorated due to elongation and destruction during rolling, the upper limit thereof may be limited to 0.0040%.

Accordingly, the content of calcium (Ca) may be 0.0005 to 0.0040%. A more preferred lower limit may be 0.0015%, and a more preferred upper limit may be 0.003%.

The steel material of the present disclosure may include balance iron (Fe) and unavoidable impurities in addition to the above-described composition. Unavoidable impurities may be unintentionally incorporated in the normal manufacturing process, and cannot thus be excluded. Since these impurities are known to anyone skilled in the steel manufacturing field, all thereof are not specifically mentioned in this specification.

Hereinafter, the steel microstructure of the present disclosure will be described in detail.

In the present disclosure, % representing the fraction of microstructure is based on the area unless otherwise specified.

The microstructure of the center in the range of t/4 to t/2 (where t means the thickness of the steel plate) of the steel material satisfying the alloy composition according to one aspect of the present disclosure is composed of, by area %, 35 to 40% of ferrite and the balance bainite, and a packet size of the bainite may be 10 μm or less. In addition, the porosity of the center of the steel may be 0.1 $mm^3/g$ or less.

In the case in which structures other than 35 to 40% of ferrite and the remainder of bainite are formed, it is difficult to secure the low-temperature impact toughness properties targeted in the present disclosure. In particular, if ferrite is less than 35%, the strength is excessively exceeded and the core low-temperature impact toughness cannot be adequately secured, and if it exceeds 40%, there is a problem in that the tensile strength value required in the present disclosure cannot be secured due to a decrease in strength.

When measured by EBSD, the bainite packet size may determine the grain size centered on the high-tilt angle grain boundary of 15°, and may be limited to 10 μm or less in consideration of −60° C. low-temperature impact toughness, more preferably to 8 μm or less. However, considering the possible level of grain refinement by rolling or the like, the lower limit may be limited to 5 μm.

In order to secure the low-temperature impact toughness targeted in the present disclosure, the porosity in the center of the steel may be 0.1 $mm^3/g$ or less, and if it exceeds 0.1 $mm^3/g$, it may act as a crack initiation point and the product may be damaged in case of impact.

The average size of prior austenite grains of the steel material according to one aspect of the present disclosure may be 20 μm or less.

Right after hot rolling, the grain size of the center of the steel is controlled to secure the appropriate impact toughness and absorbed energy value at −60° C., and if the prior austenite average grain size exceeds 20 μm, coarse ferrite is formed and there is a problem in that the size of the remaining bainite packets is also difficult to control.

Hereinafter, the steel manufacturing method of the present disclosure will be described in detail.

Steel according to one aspect of the present disclosure may be produced by primary heating and primary forging, secondary heating and secondary forging, tertiary heating and hot rolling and cooling of a steel slab satisfying the above-described alloy composition.

Primary Heating and Primary Forging

After heating the steel slabs satisfying the above-mentioned alloy composition in the temperature range of 1100 to 1300° C., the primary intermediate material may be manufactured by primary forging at a cumulative reduction of 3 to 15% and a strain rate of 1 to 4/s.

The complex carbonitride of Ti, Nb or the coarse crystallized TiNb (C, N) or the like formed during casting is re-dissolved, and the austenite before the primary forging is heated and maintained to a recrystallization temperature or higher to homogenize the structure, and may be heated in a temperature range of 1100° C. or higher to secure a sufficiently high forging end temperature to minimize surface cracks that may occur in the forging process. On the other hand, if the heating temperature is excessively high, problems may occur due to oxide scale at high temperatures, and manufacturing costs may increase excessively due to cost increases due to heating and maintenance, and thus the upper limit thereof may be limited to 1300° C. In the present disclosure, the thickness of the slab may be 650 to 750 mm, preferably 700 mm.

The primary forging may be processed to the targeted width of the primary intermediate material while forging the slab to a thickness of 450 to 550 mm in the temperature range of 1100 to 1300° C., which is the primary heating temperature. Since high-strain low-speed forging is essential to sufficiently compress the voids, the forging speed may be limited to 1 to 4/s.

If the cumulative reduction is less than 3%, the remaining voids in the slab cannot be sufficiently compressed, resulting in residual voids, which may degrade the resistance to lamellar tearing of the product. A preferred cumulative reduction of primary forging may be 5% or more, and a more preferred cumulative reduction of primary forging may be 7% or more. However, if the dislocation density is recovered or the cumulative reduction at the non-recrystallization temperature or less, which is not offset by recrystallization, exceeds 15%, the uniform elongation of the surface is extremely reduced due to the work hardening of the overlapped dislocations, and surface cracks may occur during the forging process. A preferred cumulative reduction of primary forging may be 13% or less, and a more preferred cumulative reduction of primary forging may be 11% or less.

Secondary Heating and Secondary Forging

After secondary heating of the primary intermediate material in the temperature range of 1000 to 1200° C., the secondary intermediate material may be manufactured by secondary forging at a cumulative reduction of 3 to 30% and a strain rate of 1 to 4/s.

This is a step of processing the primary intermediate material to the required thickness and length of the secondary intermediate material by heating and forging the primary intermediate material in the temperature range of 1000 to 1200° C. As in the primary forging, in order to secure the porosity at the center of the secondary intermediate material to 0.1 $mm^3/g$ or less, high strain and low speed forging is required in the secondary forging as well. In the present disclosure, the thickness of the secondary intermediate material may be 300 to 340 mm.

If the cumulative reduction in the secondary forging is less than 3%, the micropores remaining after the primary forging cannot be completely compressed, and when strain is applied to the end point of the elliptical compressed air gap, due to the notch effect, the physical properties may be inferior to those of the circular pore form, and thus it is necessary to sufficiently compress the voids with a strain of 3% or more. However, if the cumulative reduction exceeds 30%, surface cracks may occur due to surface work hardening.

The strain rate of the secondary forging may be 1 to 4/s, similar to that of the primary forging. At a speed of less than 1/s, there is room for surface cracks to occur due to the temperature drop in finish forging, and a high strain rate of more than 4/s in the non-recrystallization region may also cause a decrease in elongation and surface cracks.

Tertiary Heating

The secondary intermediate material may be heated to a temperature range of 1000 to 1200° C.

The complex carbonitride of Ti or Nb, the coarse crystallized TiNb (C, N) or the like formed during casting is re-dissolved, and the structure is homogenized by heating and maintaining austenite before hot rolling to a recrystallization temperature or higher, and tertiary heating may be performed at a temperature of 1000° C. or higher to secure a sufficiently high rolling end temperature to minimize crushing of inclusions in the rolling process. On the other hand, if the heating temperature is excessively high, problems may occur due to oxide scale at high temperatures, since the manufacturing cost may increase excessively due to the increase in cost due to heating and maintenance, the upper limit of that temperature may be limited to 1200° C.

Hot Rolling

A hot-rolled material may be produced by hot-rolling the tertiary heated secondary intermediate material at a finish hot rolling temperature of 900 to 1100° C. At this time, the thickness of the hot-rolled material may be 133 to 233 mm.

If the finish hot rolling temperature is less than 900° C., the deformation resistance value increases excessively with the decrease in temperature, so it is difficult to sufficiently refine the austenite grains in the center in the thickness direction of the product, and accordingly, the low-temperature impact toughness of the center of the final product may be inferior. On the other hand, if the temperature exceeds 1100° C., the austenite crystal grains are too coarse, and there is a concern that strength and impact toughness may be inferior.

Cooling

The prepared hot-rolled material may be cooled at a cooling rate of 3° C./s or more to a temperature range of Bs+20-Ar1+20° C.

After hot rolling is completed, an accelerated cooling process at a cooling rate of 3° C./s or more is required to obtain a fine ferrite and pearlite composite structure transformed at low temperature. If the cooling rate is less than 3° C./s, since ferrite transformation starts during the cooling process, it may be difficult to secure the fine ferrite structure of the hot-rolled material required in the present disclosure. In addition, if the cooling end temperature exceeds Ar1+20° C., it is not easy to refine because ferrite nucleates and then grows at high temperatures. If the temperature is less than Bs+20° C., the hot-rolled steel structure is transformed into bainite or martensite, and during quenching, additional grain refinement may not be obtained due to the Austenite Memory Effect during the heating process. The cooling condition to room temperature after cooling to the cooling end temperature is not particularly limited, but air cooling may be applied in the present disclosure.

Quenching and Tempering

The hot-rolled material is heated to a temperature range of 820 to 900° C., maintained for 10 to 40 minutes, and then quenched to cool at a cooling rate of 5° C./s or more, followed by tempering at 600 to 680° C. for 10 to 40 minutes.

When quenching, if the temperature is less than 820° C. or the holding time is less than 10 minutes, the carbide generated during cooling after rolling or impurity elements segregated at the grain boundary do not re-dissolve smoothly, and thus the low-temperature impact toughness of the central portion of the steel after the heat treatment may be greatly reduced. On the other hand, if the temperature exceeds 900° C. or the holding time exceeds 40 minutes, due to coarsening of austenite and coarsening of precipitated phases such as Nb(C,N), V(C,N) and the like, the resistance to lamellar tearing may deteriorate.

If the tempering temperature is less than 600° C., impingement carbon is not properly precipitated, and the strength is excessively increased, and thus it is difficult to secure the low-temperature impact toughness characteristics targeted in the present disclosure. If the temperature exceeds 680° C., the dislocation density of the matrix decreases and cementite spheroidization and coarsening become excessive, and it may thus be difficult to secure adequate strength.

Post-Weld Heat Treatment (PWHT)

In the present disclosure, post-weld heat treatment may be performed after welding the quenched and tempered steel. Conditions of the post-weld heat treatment are not particularly limited, and it may be performed under normal conditions.

The steel material of the present disclosure prepared as described above may have a thickness of 133 to 250 mm, a center section hardness of 200 HB or less, a tensile strength of 450 to 620 MPa after PWHT heat treatment of the steel material, and the low-temperature impact toughness of the center of the steel material of 80 J or more at −60° C., and no cracks occur on the surface of steel material, and excellent low temperature impact toughness characteristics may be provided.

Hereinafter, the present disclosure will be described in more detail through examples. However, it should be noted that the following examples are only for explaining the present disclosure in more detail by exemplifying the present disclosure, and are not intended to limit the scope of the present disclosure.

MODE FOR INVENTION

A cast steel having a thickness of 700 mm and having the alloy components illustrated in Table 1 was manufactured. Primary forging, secondary forging, hot rolling, cooling and QT heat treatment were performed according to the process conditions in Table 2. At this time, the primary heating temperature of 1200° C., the secondary heating temperature of 1100° C., and the tertiary heating temperature of 1050° C. were commonly applied, and the quenching and tempering time was commonly applied for 30 minutes. For the thickness of the primary intermediate material, the condition of 550 mm was applied, and for the thickness of the secondary intermediate material, the condition of 400 mm was applied. In addition, the cooling end temperature after hot rolling and the cooling rate during quenching, which are not disclosed in Table 2, were applied under conditions satisfying the range of the present disclosure.

TABLE 1

| | Alloy Component (wt %) | | | | | | | | | | | | | |
|---|---|---|---|---|---|---|---|---|---|---|---|---|---|---|
| Steel Grade | C | Si | Mn | Al | P* | S* | Nb | V | Ti | Cr | Mo | Cu | Ni | Ca* |
| A | 0.12 | 0.27 | 1.18 | 0.03 | 80 | 10 | 0.013 | 0.015 | 0.011 | 0.02 | 0.10 | 0.20 | 0.25 | 25 |
| B | 0.15 | 0.3 | 1.35 | 0.03 | 80 | 10 | 0.015 | 0.015 | 0.013 | 0.05 | 0.10 | 0.08 | 0.20 | 25 |
| C | 0.13 | 0.35 | 1.24 | 0.03 | 85 | 12 | 0.013 | 0.017 | 0.012 | 0.014 | 0.08 | 0.02 | 0.23 | 22 |
| D | 0.17 | 0.31 | 1.29 | 0.02 | 81 | 10 | 0.015 | 0.02 | 0.012 | 0.019 | 0.06 | 0.04 | 0.18 | 21 |
| E | 0.14 | 0.28 | 1.35 | 0.03 | 83 | 11 | 0.016 | 0.018 | 0.015 | 0.15 | 0.11 | 0.15 | 0.31 | 20 |
| F | 0.31 | 0.3 | 1.41 | 0.02 | 82 | 13 | 0.018 | 0.015 | 0.001 | 0.13 | 0.08 | 0.12 | 0.28 | 22 |
| G | 0.18 | 0.35 | 0.7 | 0.02 | 85 | 12 | 0.018 | 0.013 | 0.010 | 0.11 | 0.11 | 0.20 | 0.19 | 23 |

*Unit is ppm

TABLE 2

| | | Primary Forging | | Secondary Forging | | Hot Rolling Finish | | Cooling | Quenching and Tempering: Heating temperature | Quenching and Tempering: Tempering |
|---|---|---|---|---|---|---|---|---|---|---|
| Specimen Number | Steel Grade | Cumulative Reduction (%) | Strain Rate | Cumulative Reduction (%) | Strain Rate | hot rolling temperature (° C.) | Thickness (mm) | Cooling Rate (° C./s) | when quenching (° C.) | heating temperature (° C.) |
| 1 | A | 10.2 | 2.4 | 17.5 | 2.5 | 905 | 163 | 3.8 | 890 | 621 |
| 2 | B | 12 | 1.8 | 18.2 | 2.1 | 923 | 157 | 3.3 | 880 | 635 |
| 3 | C | 13 | 1.9 | 16.9 | 3.1 | 951 | 203 | 3.6 | 881 | 641 |
| 4 | D | 10.5 | 2.5 | 20.1 | 3.5 | 937 | 187 | 4.5 | 891 | 640 |
| 5 | E | 13.7 | 3.1 | 27.3 | 2.9 | 940 | 167 | 5.3 | 899 | 629 |
| 6 | A | 24.4 | 2.1 | 21.2 | 2.8 | 938 | 135 | 4.7 | 890 | 640 |
| 7 | B | 12.5 | 6.7 | 20.5 | 3.1 | 943 | 171 | 4.3 | 890 | 662 |
| 8 | C | 8.9 | 1.8 | 24.5 | 0.7 | 945 | 173 | 5.3 | 851 | 619 |
| 9 | D | 10.5 | 1.9 | 23.5 | 3.1 | 1118 | 181 | 5.1 | 860 | 627 |

TABLE 2-continued

| | | Primary Forging | | Secondary Forging | | Hot Rolling Finish | | Cooling | Quenching and Tempering Heating temperature | Tempering |
|---|---|---|---|---|---|---|---|---|---|---|
| Specimen Number | Steel Grade | Cumulative Reduction (%) | Strain Rate | Cumulative Reduction (%) | Strain Rate | hot rolling temperature (° C.) | Thickness (mm) | Cooling Rate (° C./s) | when quenching (° C.) | heating temperature (° C.) |
| 10 | E | 9.4 | 1.7 | 26.1 | 1.8 | 962 | 166 | 3.5 | 765 | 631 |
| 11 | E | 8.6 | 2.6 | 26.9 | 2.9 | 944 | 181 | 4.1 | 861 | 532 |
| 12 | F | 10.5 | 2.5 | 25.3 | 2.5 | 956 | 171 | 3.9 | 843 | 667 |
| 13 | G | 8.4 | 2.7 | 26.4 | 3.0 | 958 | 162 | 4.3 | 867 | 643 |

The microstructure and mechanical properties of the prepared steel were measured. The fraction of the microstructure was measured through a scanning electron microscope, and after Lepera etching the tissue specimen, an optical image was captured, and then, the tissue fraction was measured using an automatic image analyzer. At this time, the microstructure and porosity of the center in the range of t/4 to t/2 (where t means the thickness of the steel plate) were measured. The uniform elongation of the surface layer of the slab represents the value of the elongation measured at the maximum tensile stress portion after performing a tensile test on a tensile specimen prepared with the surface of the slab in the primary forging temperature range. In the size of the bainite packet, the grain size was determined centering on the high-tilt angle grain boundary of 15° by EBSD, and the cross-sectional surface hardness was measured using a Brinell hardness tester based on the cross-sectional hardness at the center of the specimen.

In addition, in Table 4 below, the mechanical properties are illustrated by measuring the tensile strength after PWHT and the low-temperature impact toughness at −60° C. After visually observing the surface of the steel material, grinding was performed at the point where the surface crack was formed, and the grinding depth until the crack disappeared was measured as the depth of the surface crack.

TABLE 3

| | | Prior-sustenite | Slab | Steel after QT heat treatment | | | | | | |
|---|---|---|---|---|---|---|---|---|---|---|
| Specimen Number | Steel Grade | average grain size (μm) | surface uniform elongation (%) | Ferrite (area %) | Bainite (area %) | Bainite packet size (μm) | Fresh martensite (area %) | Porosity ($mm^3/g$) | Section Hardness (HB) | Division |
| 1 | A | 18.2 | 16.2 | 35.3 | 64.7 | 8.3 | 0 | 0.07 | 192 | Inventive Example 1 |
| 2 | B | 16.9 | 15.4 | 35.8 | 64.2 | 9.4 | 0 | 0.06 | 198 | Inventive Example 2 |
| 3 | C | 17.5 | 16.3 | 37.2 | 62.8 | 8.5 | 0 | 0.05 | 194 | Inventive Example 3 |
| 4 | D | 18.3 | 15.8 | 38.3 | 61.7 | 7.9 | 0 | 0.03 | 197 | Inventive Example 4 |
| 5 | E | 17.6 | 15.9 | 36.2 | 63.8 | 6.9 | 0 | 0.04 | 198 | Inventive Example 5 |
| 6 | A | 18.3 | 16.4 | 35.9 | 64.1 | 8.3 | 0 | 0.06 | 193 | Comparative Example 1 |
| 7 | B | 19.1 | 7.3 | 37.6 | 62.4 | 9.0 | 0 | 0.08 | 192 | Comparative Example 2 |
| 8 | C | 15.7 | 16.9 | 38.1 | 61.9 | 9.2 | 0 | 0.27 | 188 | Comparative Example 3 |
| 9 | D | 30.6 | 15.9 | 38.2 | 61.8 | 14.7 | 0 | 0.04 | 180 | Comparative Example 4 |
| 10 | E | 18.2 | 14.7 | 39.1 | 13.9 | 7.9 | 47 | 0.05 | 300 | Comparative Example 5 |
| 11 | E | 18.9 | 15.0 | 39.2 | 60.8 | 9.1 | 0 | 0.04 | 275 | Comparative Example 6 |
| 12 | F | 17.3 | 15.8 | 0 | 100 | 8.3 | 0 | 0.04 | 189 | Comparative Example 7 |
| 13 | G | 18.6 | 16.7 | 91.5 | 8.5 | 8.5 | 0 | 0.03 | 190 | Comparative Example 8 |

F: ferrite, B: bainite, FM: fresh martensite

TABLE 4

| Specimen Number | Steel Grade | Steel after PWHT: Tensile Strength (MPa) | Steel after PWHT: LOW temperature impact toughness (−60° C., J) | Steel after PWHT: Surface crack depth (mm) | Division |
|---|---|---|---|---|---|
| 1 | A | 493 | 189 | 0 | Inventive Example 1 |
| 2 | B | 486 | 215 | 0 | Inventive Example 2 |
| 3 | C | 504 | 210 | 0 | Inventive Example 3 |
| 4 | D | 515 | 215 | 0 | Inventive Example 4 |
| 5 | E | 490 | 231 | 0 | Inventive Example 5 |
| 6 | A | 530 | 207 | 11.4 | Comparative Example 1 |
| 7 | B | 507 | 215 | 8.7 | Comparative Example 2 |
| 8 | C | 533 | 17 | 0 | Comparative Example 3 |
| 9 | D | 547 | 21 | 0 | Comparative Example 4 |
| 10 | E | 645 | 33 | 0 | Comparative Example 5 |
| 11 | E | 630 | 18 | 0 | Comparative Example 6 |
| 12 | F | 684 | 13 | 10.5 | Comparative Example 7 |
| 13 | G | 427 | 385 | 0 | Comparative Example 8 |

As illustrated in Table 3, it can be confirmed that the examples of the invention satisfying the alloy composition and manufacturing method proposed in the present disclosure satisfy all mechanical properties aimed at in the present disclosure.

On the other hand, Comparative Examples 1 and 2 are cases in which the cumulative reduction and strain rate in the primary forging exceed the range of the present disclosure, and since the uniform elongation of the slab surface layer in the forging temperature range did not satisfy the range of the present disclosure, cracks occurred on the surface of the steel.

In Comparative Example 3, during the secondary forging, the strain rate was less than the scope of the present disclosure, and the low-temperature impact toughness did not meet the range proposed in the present disclosure due to excessive voids in the center of the steel.

In Comparative Example 4, the finish hot rolling temperature exceeded the range of the present disclosure, the average prior austenite grain size was excessive, and the bainite packet size became coarse after quenching and tempering, resulting in poor low-temperature impact toughness.

In Comparative Examples 5 and 6, the heating temperature during quenching and tempering, respectively, fell short of the range of the present disclosure. In the case of Comparative Example 5, fresh martensite was formed and the hardness was excessive. In the case of Comparative Example 6, the hardness of bainite was excessive, and the hardness of the center section was excessively increased.

In the case of Comparative Example 7, the content of C exceeded the range of the present disclosure, and bainite was excessively formed, and as a result, the tensile strength was excessively increased, the low-temperature impact toughness was lowered, and cracks were also generated.

In the case of Comparative Example 8, Mn did not satisfy the range of the present disclosure, and ferrite was excessively formed, and thus tensile strength was not sufficiently secured.

Although the present disclosure has been described in detail through examples above, other types of embodiments are also possible. Therefore, the spirit and scope of the claims set forth below are not limited to the embodiments.

The invention claimed is:

1. A steel material comprising:

in weight %, carbon (C): 0.10 to 0.25%, silicon (Si): 0.05 to 0.50%, manganese (Mn): 1.0 to 2.0%, aluminum (Al): 0.005 to 0.1%, phosphorus (P): 0.010% or less, sulfur (S): 0.0015% or less, niobium (Nb): 0.001 to 0.03%, vanadium (V): 0.001 to 0.03%, titanium (Ti): 0.001 to 0.03%, chromium (Cr): 0.01 to 0.20%, molybdenum (Mo): 0.01 to 0.15%, copper (Cu): 0.01 to 0.50%, nickel (Ni): 0.05 to 0.50%, calcium (Ca): 0.0005 to 0.0040%, with a balance Fe and unavoidable impurities, wherein a microstructure in a center in a range of t/4 to t/2 (where t indicates ae thickness of a steel plate) consists of 35 to 40% of ferrite and a remainder of bainite composite structure in area %, a packet size of the bainite is 10 μm or less, and a porosity of the center is 0.1 $mm^3/g$ or less, a depth of a surface crack is 0.5 mm or less, and a center section hardness is 200 HB or less.

2. The steel material of claim 1, wherein a prior austenite average grain size of the steel material is 20 μm or less.

3. The steel material of claim 1, wherein a thickness of the steel material is 133 to 250 mm.

4. The steel material of claim 1, wherein the steel material has a tensile strength of 450 to 650 MPa after PWHT and a center low-temperature impact toughness of 80 J or more at −60° C.

5. A method of manufacturing a steel material, comprising:

primarily heating a steel slab having a thickness of 650 to 750 mm at a temperature ranging from 1100 to 1300° C., and then performing primary forging at a cumulative reduction of 3 to 15% and a strain rate of 1 to 4/s, and obtaining a primary intermediate material, the steel slab containing, in weight %, carbon (C): 0.10 to 0.25%, silicon (Si): 0.05 to 0.50%, manganese (Mn): 1.0 to 2.0%, aluminum (Al): 0.005 to 0.1%, phosphorus (P): 0.010% or less, sulfur (S): 0.0015% or less, niobium (Nb): 0.001 to 0.03%, vanadium (V): 0.001 to 0.03%, titanium (Ti): 0.001 to 0.03%, chromium (Cr): 0.01 to 0.20%, molybdenum (Mo): 0.01 to 0.15%, copper (Cu): 0.01 to 0.50%, nickel (Ni): 0.05 to 0.50%, calcium (Ca): 0.0005 to 0.0040%, with a balance Fe and unavoidable impurities;

after secondary heating of the primary intermediate material at a temperature ranging from 1000 to 1500° C., performing secondary forging processing at a cumulative reduction of 3 to 30% and a strain rate of 1 to 4/s, and obtaining a secondary intermediate material;

a tertiary heating operation of heating the secondary intermediate material to a temperature range of 1000 to 1200° C.;

obtaining a hot-rolled material by hot-rolling the tertiary heated secondary intermediate material at a finish hot rolling temperature of 900 to 1100° C.;

cooling the hot-rolled material;

a quenching operation of heating the cooled hot-rolled material at a temperature ranging from 820 to 900° C., maintaining for 10 to 40 minutes, and then cooling at a cooling rate of 5° C./s or more; and a tempering operation of holding the quenched steel at 600 to 680° C. for 10 to 40 minutes.

6. The method of manufacturing the steel material of claim 5, wherein in the cooling, the hot-rolled material is cooled at a cooling rate of 3° C./s or more to a temperature range of Bs+20 to Ar1+20° C.

7. The method of manufacturing the steel material of claim 5, further comprising an operation of cooling the hot-rolled material to a cooling end temperature and then air-cooling to room temperature.

8. The method of manufacturing the steel material of claim 5, wherein a thickness of the primary intermediate material is 450 to 550 mm.

9. The method of manufacturing the steel material of claim 5, wherein a thickness of the secondary intermediate material is 300 to 340 mm.

10. The method of manufacturing the steel material of claim 5, wherein a thickness of the hot-rolled material is 133 to 250 mm.

* * * * *